US007766609B1

(12) United States Patent
Liang

(10) Patent No.: US 7,766,609 B1
(45) Date of Patent: Aug. 3, 2010

(54) TURBINE VANE ENDWALL WITH FLOAT WALL HEAT SHIELD

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 709 days.

(21) Appl. No.: 11/805,733

(22) Filed: May 24, 2007

(51) Int. Cl.
*F01D 5/08* (2006.01)

(52) U.S. Cl. ..... 415/138; 415/139; 415/191; 415/208.2

(58) Field of Classification Search ..... 415/115, 415/116, 138, 139, 191, 208.2
See application file for complete search history.

(56) References Cited

U.S. PATENT DOCUMENTS 3,446,481 A * 5/1969 Kydd ..... 416/92
3,446,880 A * 5/1969 Enicks ..... 264/46.6
3,628,880 A 12/1971 Smuland et al
3,950,113 A * 4/1976 Albrecht ..... 416/97 A
4,218,178 A * 8/1980 Irwin ..... 415/114
4,648,802 A * 3/1987 Mack ..... 416/244 A
4,712,979 A 12/1987 Finger
5,161,949 A * 11/1992 Brioude et al. ..... 416/193 A
5,174,714 A 12/1992 Plemmons et al.
5,195,868 A 3/1993 Plemmons
5,197,852 A 3/1993 Walker et al.
5,244,345 A * 9/1993 Curtis ..... 416/95
6,491,093 B2 12/2002 Kreis et al.
6,514,041 B1 2/2003 Matheny et al.
6,632,070 B1 * 10/2003 Tiemann ..... 415/191
6,726,448 B2 4/2004 McGrath et al.
6,830,427 B2 12/2004 Lafarge et al.
7,001,141 B2 2/2006 Cervenka
7,052,234 B2 * 5/2006 Wells et al. ..... 415/137
7,097,418 B2 8/2006 Trindade et al.

FOREIGN PATENT DOCUMENTS

EP 1557534 A1 * 7/2005

* cited by examiner

*Primary Examiner*—Igor Kershteyn
(74) *Attorney, Agent, or Firm*—John Ryznic

(57) ABSTRACT

A float wall heat shield for use on an endwall of a stator vane used in a gas turbine engine. The heat shield includes an attachment extending from a center of the heat shield to secure the shield to the vane. A plurality of ribs formed on the inside surface of the shield forms cooling channels extending in the streamwise direction. The leading edge of the shield curves downward over the leading edge of the endwall and forms a cooling air inlet. The trailing edge of the shield forms a cooling air exit extending in a straight direction to provide purge air for a rim cavity of an adjacent rotor blade assembly. The heat shield includes pressure and suction sides that conform to an outline of the airfoil of adjacent vanes, and forms cooling air exit gaps so that the cooling air passing through the channels can discharge to prevent inflow of the hot gas flow. The heat shield eliminates the need for film cooling holes.

13 Claims, 4 Drawing Sheets

TURBINE VANE ENDWALL WITH FLOAT WALL HEAT SHIELD

BACKGROUND OF THE INVENTION

1. Field of the Invention

The present invention relates generally to a gas turbine engine, and more specifically to a turbine vane with a heat shield on the shroud.

2. Description of the Related Art Including Information Disclosed Under 37 CFR 1.97 and 1.98

A gas turbine engine includes a turbine section with multiple stages of stator vanes and rotor blades to extract mechanical energy from a hot gas flow passing from the combustor and through the turbine. Stator vanes guide the gas flow into the rotor blades for higher efficiency. The stator vanes and rotor blades include complex internal cooling passages and film cooling hole arrangements to provide cooling of the airfoils in order that a higher temperature can be used in the turbine. Higher temperatures result in higher efficiencies.

The stator vanes are located upstream of an adjacent rotor blade arrangement. The stator vanes include an airfoil portion that extends between an inner and an outer shroud. The inner and outer shrouds form a flow guiding surface that is exposed to the hot gas flow. The shrouds are also cooled by passing cooling air along the inner surface and with film cooling holes that supply a jet of film cooling air into the hot gas flow. FIG. 1 shows a prior art turbine vane endwall leading edge region that is cooled with a double row of circular or shaped film cooling holes. In the FIG. 1 vane, a streamwise and circumferential cooling flow control due to airfoil external hot gas temperature and pressure variation is difficult to achieve. Film cooling air that is discharged from the double film rows have a tendency to migrate from the pressure side toward the vane suction surface which induces a mal-distribution of film cooling flow and endwall metal temperature. Multiple rows of shaped discrete film holes are used for this cooling of the pressure side and suction side of the endwall surfaces. As a result of this cooling approach, a large amount of cooling air is used for the cooling of vane endwall surface which yields a high mixing loss for the turbine stage due to cooling air interacting with the mainstream hot gas flow. The mixing losses are especially higher for the cooling rows that discharge beyond the gage point.

It is an object of the present invention to provide for a turbine stator vane with better cooling for the inner and outer shrouds.

It is another object of the present invention to provide for better cooling of the inner and outer shrouds of the turbine stator vanes which make use of less cooling air.

It is another object of the present invention to provide cooling for the turbine stator vane shrouds which eliminate the use of active film cooling holes for the vane endwall and therefore greatly reduce the mixing loses due to cooling air interaction with the main stream hot gas flow.

BRIEF SUMMARY OF THE INVENTION

A turbine stator vane with a float wall heat shield on the vane endwalls to shield the endwalls from the hot gas flow and to provide backside cooling for the heat shield. The float wall heat shield is made from a high temperature resistant material such as a carbon matrix composite with ribs on the inner surface that form axial and circumferential cooling channels. The float wall heat shield is supported by a single pin hole attachment in order that the four edges are free to expand due to thermal exposure. Cooling air is supplied to the backside of the heat shield and discharged out the sides to prevent hot gas flow emigration between adjoining endwalls.

DETAILED DESCRIPTION OF THE INVENTION

Figure 1:
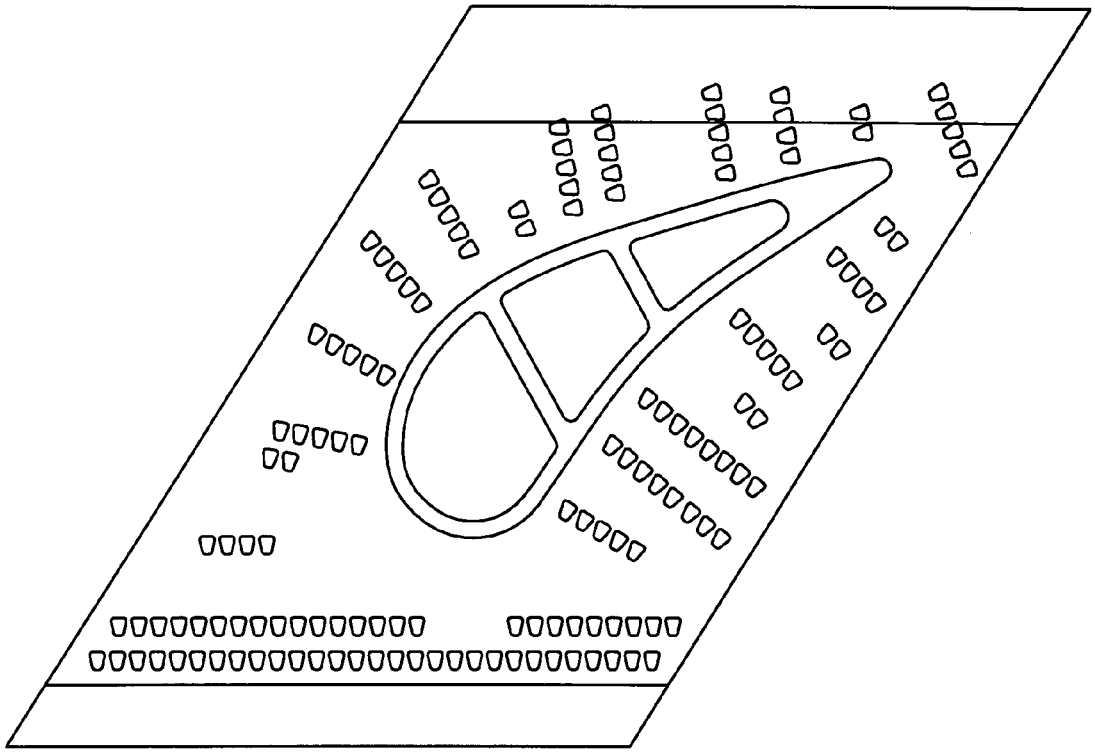
Fig 1 Prior Art
FIG. 1 shows a prior art stator vane endwall cooling design with film cooling holes.
Figure 2:
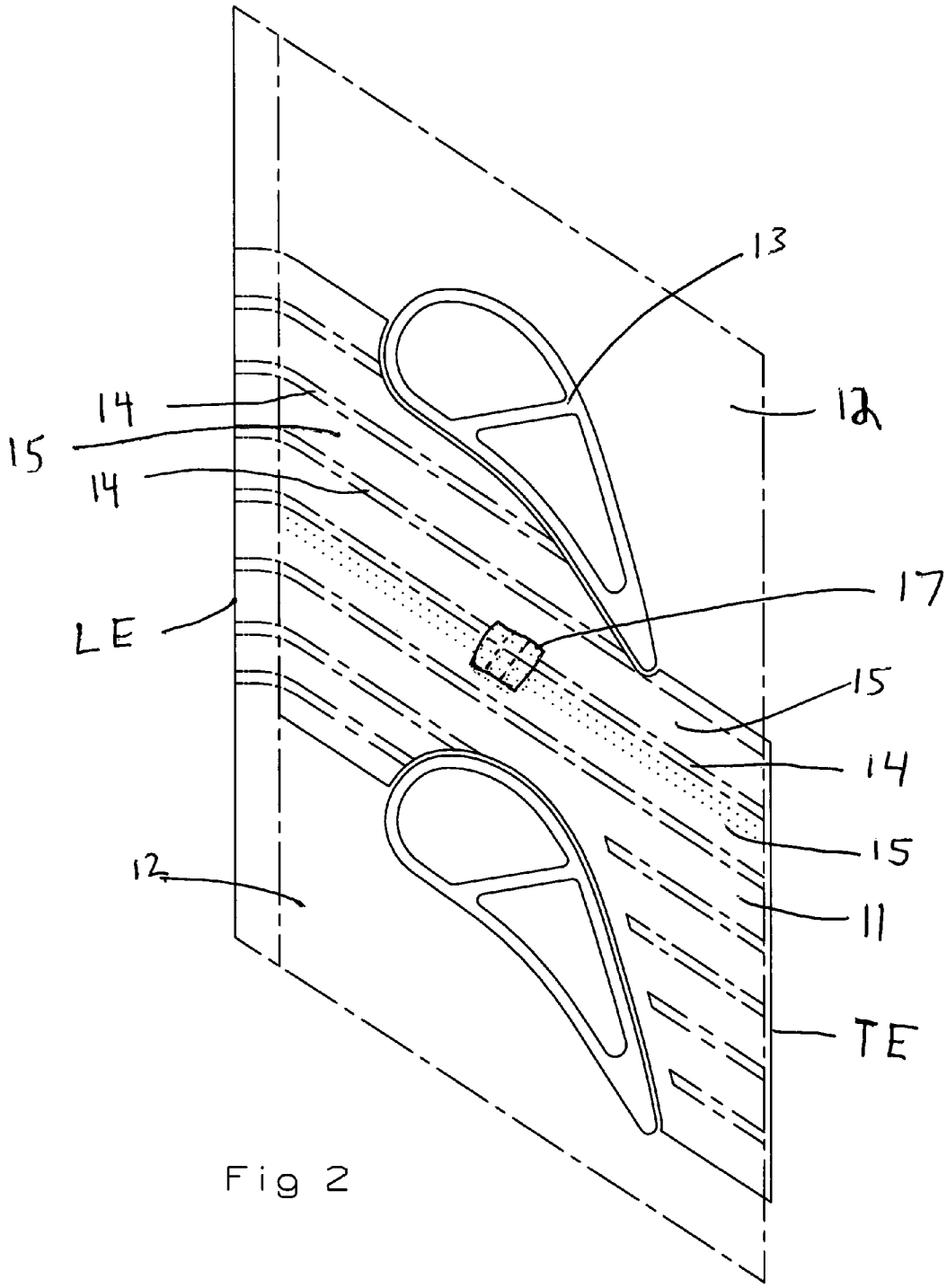
FIG. 2 shows a top view of a pair of vanes with the heat shield of the present invention.

FIG. 2 shows a top view of a pair of vanes with the heat shield of the present invention secured to the endwall. Two stator vanes each with an airfoil 13 extends from the vane metal endwall 12. In FIG. 2, the endwall between the two airfoils 13 shown is covered with a float wall heat shield 11 that extends between the two airfoils 13. The heat shield 11 includes a plurality of ribs 14 extending from the leading edge (LE) side to the trailing edge (TE) side of the endwall. Cooling channels 15 are formed between adjacent ribs 14. A heat shield attachment 17 is located around the center of the heat shield and is used to secure the heat shield to a vane attachment so that the four sides of the heat shield are free to move under thermal loads which is further described below with respect to FIGS. 3 and 4.

Figure 3:
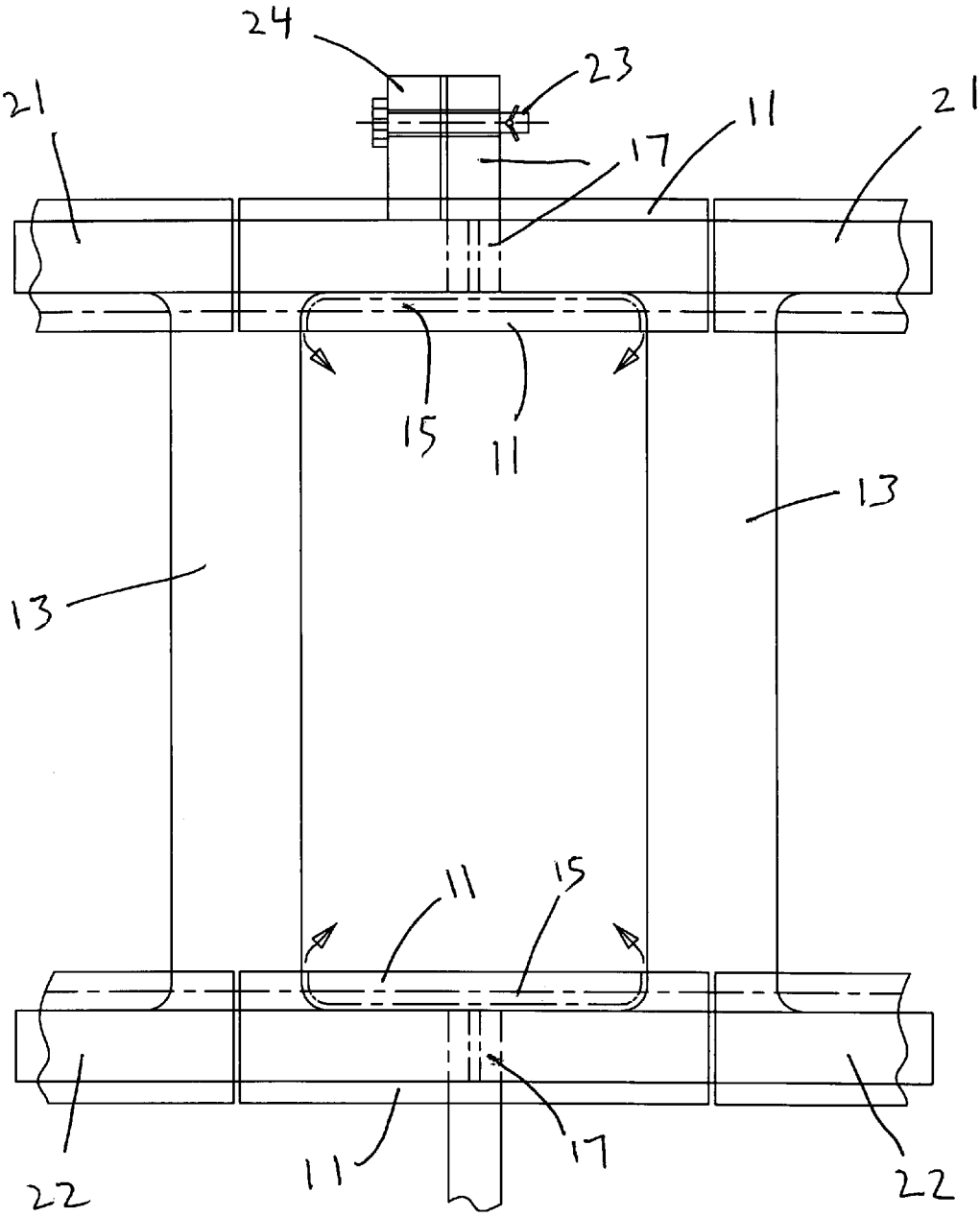
FIG. 3 shows a front view of the endwall heat shield assembly of the present invention.

The heat shield is shown in FIG. 3 attached to the vane attachment by a pin 23. In FIG. 3, two of the airfoils 13 are shown extending between the outer diameter endwall 21 and the inner diameter endwall 22. An upper heat shield 11 is secured to the vane attachment 24 by a pin 23. The cooling channel 15 on the inside surface of the heat shield 11 is shown extending from right to left in the figure. Cooling air passing through the channels 15 formed between ribs out to the sides of the endwall and discharge into the hot gas flow stream as shown by the arrows in FIG. 3. The heat shields 11 curve around the leading edge side of the endwalls 21 and 22 to shield the endwalls from the hot gas flow.

Figure 4:
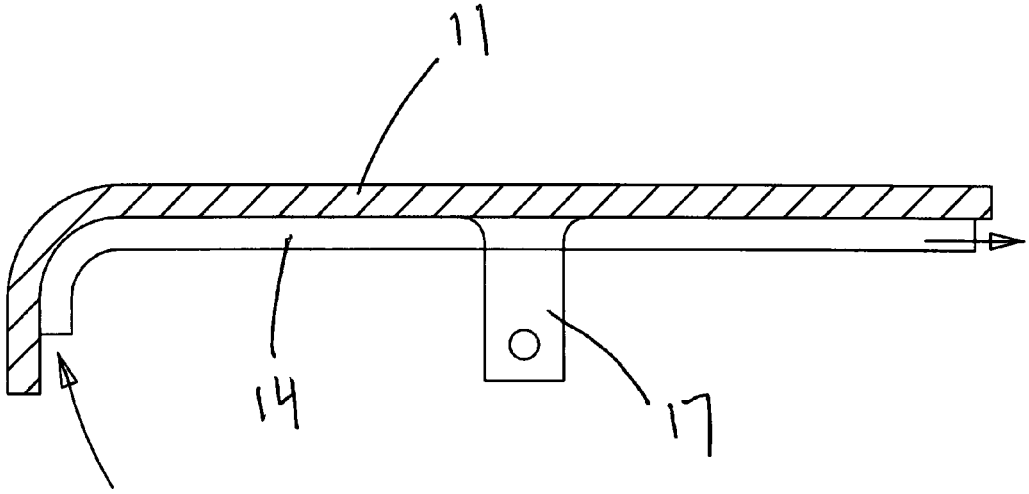
FIG. 4 shows a cross section view of the heat shield of the present invention from a leading edge side to the trailing edge side.

A detailed view of the heat shield 11 is shown in FIG. 4 with the leading edge side of the left in this figure and the trailing edge side on the right side. The leading edge side of the heat shield is curved downward to cover the endwall as seen in FIG. 3. a rib 14 formed on the underside of the heat shield 11 extends from right to left in this figure so that adjacent ribs 14 form the cooling channels 15. The heat shield attachment 17 extends from the inside surface and includes a pin attachment hole to secure the heat shield to the vane attachment 24 shown in FIG. 3. A single attachment projection 17 is used and is located around the center of the heat shield so that the heat shield can float against the endwall. A float wall heat shield is a heat shield in which the sides can growth or expand from the thermal exposure without buckling due to restraining the edges. Cooling air is impinged onto the backside surface of the heat shield 11 on which the ribs 14 are formed.

In operation, cooling air is provided by the vane cooling air manifold. Cooling air is fed to the vane heat shield leading edge forward entrance section into the axial cooling channels formed between the heat shield and the metal endwall. The cooling air is then channeled through the cooling channel to flow streamwise along the vane endwall prior to discharging at the rim cavity between the vane and the rotor blade for use as rim cavity purge air. A portion of the cooling air can also be discharged along the vane fillet region to provide cooling and purge air for the vane fillet region.

The heat shield 11 is made from a high temperature CMC or Carbon-Carbon material for exposure to as high a heat load as possible. With the float wall heat shield of the present invention, no film cooling holes are needed to cool the endwall region. The heat shield provides for a thermal shield for the metal endwall and for cooling of the metal endwalls by the passing of cooling air through the channels formed between the ribs on the heat shield. The metal substrate structure will carry the loading for the vane stage while the heat shield will insulate the metal substrate from the hot gas heat load and expand freely on the endwall flow path axially as well as circumferentially. This minimizes the mechanical and thermally induced stresses.

I claim the following:

1. A stator vane for use in a gas turbine engine, the vane comprising:

an endwall;

an airfoil extending from the endwall;

a heat shield secured to the vane and forming a cooling air passage between the heat shield and the endwall surface; and, the heat shield includes an attachment located near the center of the heat shield such that the heat shield sides are free to move under thermal loads.

2. The stator vane of claim 1, and further comprising:

the heat shield includes a leading edge side that curves downward and over the endwall to shield the leading edge endwall from the hot gas flow.

3. The stator vane of claim 2, and further comprising:

the heat shield includes a trailing edge side with the cooling channels opening in a straight line to provide rim cavity purge air.

4. A stator vane for use in a gas turbine engine, the vane comprising:

an endwall;

an airfoil extending from the endwall;

a heat shield secured to the vane and forming a cooling air passage between the heat shield and the endwall surface; and, the heat shield includes a plurality of ribs on the inside surface of the heat shield and extending in a direction substantially parallel to the hot gas flow through the vane, the ribs forming cooling air channels.

5. The stator vane of claim 4, and further comprising:

the heat shield is formed substantially from a ceramic matrix composite material.

6. The stator vane of claim 4, and further comprising:

the heat shield is formed substantially from a carbon-carbon material.

7. A stator vane for use in a gas turbine engine, the vane comprising:

an endwall;

an airfoil extending from the endwall;

a heat shield secured to the vane and forming a cooling air passage between the heat shield and the endwall surface; and, the heat shield includes side ends adjacent to vane airfoils and includes cooling air gaps such that the cooling air passing through the cooling channels can pass out from the gaps to limit hot gas ingestion.

8. A stator vane for use in a gas turbine engine, the vane comprising:

an endwall;

an airfoil extending from the endwall;

a heat shield secured to the vane and forming a cooling air passage between the heat shield and the endwall surface; and, the heat shield includes a leading edge side and a trailing edge side, and a pressure side and a suction side, the leading edge side being curved downward over an endwall, and the pressure side and suction side being curved to follow an outline of the vanes such that a cooling air gap is formed between the heat shield and the vane.

9. A float wall heat shield for use to shield a stator vane endwall from a hot gas flow through a gas turbine engine, the heat shield comprising:

a heat shield surface having a leading edge and a trailing edge side and a pressure side and a suction side;

a plurality of ribs formed on the inner side of the heat shield and extending substantially in a streamwise direction, the ribs forming cooling air channels; and, a heat shield attachment to secure the heat shield to a vane.

10. The float wall heat shield of claim 9, and further comprising:

the leading edge of the heat shield curves downward and over an endwall; and, a cooling air inlet formed at the leading edge side.

11. The float wall heat shield of claim 10, and further comprising:

the trailing edge of the heat shield extends substantially straight and forms a cooling air exit to discharge cooling air.

12. The float wall heat shield of claim 9, and further comprising:

the pressure side and suction side is curved to follow the airfoil shape of the vanes, and cooling air gaps are formed in the sides for discharging cooling air.

13. The float wall heat shield of claim 9, and further comprising:

the edges of the heat shield are free to move under thermal growth, and the heat shield is supported solely by the heat shield attachment.

* * * * *